US010612870B2

(12) United States Patent
Borges et al.

(10) Patent No.: US 10,612,870 B2
(45) Date of Patent: Apr. 7, 2020

(54) UNFINISHED FIREARM FRAME AND JIG

(71) Applicant: Polymer 80, Inc., Dayton, NV (US)

(72) Inventors: David Borges, Fairfield, CA (US); Loran Kelley, Carson City, NV (US); Grant Griffard, Soquel, CA (US); Michael Guttridge, Dixon, CA (US)

(73) Assignee: POLYMER80, INC., Dayton, NV (US)

( * ) Notice: Subject to any disclaimer, the term of this patent is extended or adjusted under 35 U.S.C. 154(b) by 0 days.

(21) Appl. No.: 15/616,537

(22) Filed: Jun. 7, 2017

(65) Prior Publication Data

US 2017/0350665 A1 Dec. 7, 2017

Related U.S. Application Data

(60) Provisional application No. 62/346,600, filed on Jun. 7, 2016.

(51) Int. Cl.

| | |
|---|---|
| ***F41A 3/66*** | (2006.01) |
| ***F41C 23/10*** | (2006.01) |
| ***F41A 19/11*** | (2006.01) |
| ***F41A 11/02*** | (2006.01) |

(52) U.S. Cl.

CPC ..... *F41A 3/66* (2013.01); *F41A 11/02* (2013.01); *F41A 19/11* (2013.01); *F41C 23/10* (2013.01)

(58) Field of Classification Search

CPC .. F41A 3/66; F41A 11/02; F41A 11/00; F41A 11/04

USPC ..... 42/107, 108

See application file for complete search history.

(56) References Cited

U.S. PATENT DOCUMENTS

| | | | | |
|---|---|---|---|---|
| 6,253,479 | B1 * | 7/2001 | Fuchs | F41A 17/36 42/70.02 |
| 6,401,379 | B1 * | 6/2002 | Moon | F41A 3/66 42/71.01 |
| 9,009,986 | B1 * | 4/2015 | Chang | F41A 3/66 33/640 |
| 9,958,224 | B2 * | 5/2018 | Agnelli, Jr. | F41A 23/18 |

(Continued)

FOREIGN PATENT DOCUMENTS

| | | | | |
|---|---|---|---|---|
| EP | 1031811 | A2 * | 8/2000 | F41A 3/66 |

OTHER PUBLICATIONS

Borges, David, "PF940 Pistol Frame—80% Milling Instructions". Jun. 9, 2016, Polymer80, All Pages, <https://www.polymer80.com/media/wysiwyg/porto/instructions/Polymer80-PF940-Instructions.pdf>, accessed Feb. 22, 2019. (Year: 2016).

*Primary Examiner* — Stephen Johnson

(74) *Attorney, Agent, or Firm* — Bennet K. Langlotz; Langlotz Patent & Trademark Works, LLC

(57) ABSTRACT

An unfinished firearm frame having a top adapted to receive a slide. Where rear restriction protrusions extend from the top of the frame near a rear of the frame which restricts addition of the slide to the frame and front restriction protrusions extend from the top of the frame and forward of the at least one rear restriction protrusion which restricts addition of the slide to the frame. Where there is a recoil assembly block adapted to prevent a recoil assembly from being assembled into the frame. A jig having a right side and a left side to receive and clamp the frame. The jig including three pin hole guides, a removal guide edge for each of the at least one rear restriction protrusion and the at least one front restriction protrusion and a recoil assembly cutout to allow a tool to pass to the recoil assembly block.

10 Claims, 14 Drawing Sheets

(56) References Cited

U.S. PATENT DOCUMENTS

| | | | | |
|---|---|---|---|---|
| 2016/0146559 | A1* | 5/2016 | Bantle | F41A 17/34<br>42/16 |
| 2017/0095907 | A1* | 4/2017 | McClain | F41A 23/18 |

* cited by examiner

UNFINISHED FIREARM FRAME AND JIG

CROSS-REFERENCE TO RELATED APPLICATION

This application claims the benefit of U.S. Provisional Patent Application No. 62/346,600 filed on Jun. 7, 2016, entitled "Process to Create an Unfinished Pistol Receiver," which is hereby incorporated by reference in its entirety for all that is taught and disclosed therein.

FIELD OF THE INVENTION

The present invention relates to firearms, and more particularly to unfinished firearm frames.

BACKGROUND OF THE INVENTION

The assembly of firearms from parts instead of purchasing a complete firearm has become popular with the purchasers of firearms. It has become a hobby that allows the firearm to be customized with the desired features by the purchaser. When a purchaser buys a completed firearm from the dealer, that purchaser usually ends up spending more money on customizing the firearm, while discarding parts that originally were part of the firearm. Popular changes to completed firearms are trigger replacement, barrel replacement, sight replacement and weight reduction modifications.

One of the parts of the firearm is always engraved with a serial number and registered with various government agencies. The registered part is generally considered as the firearm for registration purposes and is usually the receiver or frame of the firearm. The purchaser can purchase only the registered part and build a firearm by purchasing the other required parts to complete the firearm Under the law in most jurisdictions, a purchaser can machine a firearm without registration of that part that is normally registered. The unregistered machined part usually has restrictions from sale to others and must remain with the person who machined the unregistered part. If a transfer of the unregistered part takes place, the normal federal firearms regulations which include serialization, registration and background checks are required to be performed on the recipient of the firearm. An issue with machining the firearm from scratch is that most purchasers do not have a machine shop or the skills to machine such parts.

Machine shops and polymer manufacturers can manufacture firearms receivers up to a point of incompletion, that allows them to sell the unfinished frame to customers, who then proceed to finish the frame for their personal use. Under the federal law, if the part is only completed eighty percent or less of the effort to provide a completed part that requires registration, the part is considered not being a firearm. It should be noted that the "80%" description is not recognized by the ATF as an official technical term, but is understood as a classification or description of the type of component that is being produced within the firearms industry. The part being classified as a non-firearm allows the part to be sold by manufacturers without violating the law.

It is an object of the present invention to provide an unfinished firearm frame that can be completed by a purchaser.

SUMMARY OF THE INVENTION

An unfinished firearm frame including areas adapted to install firearm parts to finish the unfinished firearm frame.

The frame having a top adapted to receive a slide. Where there is at least one rear restriction protrusion extending from the top of the frame near a rear of the frame which restricts addition of the slide to the frame and at least one front restriction protrusion extending from the top of the frame and forward of the at least one rear restriction protrusion which restricts addition of the slide to the frame. Where there is a recoil assembly block adapted to prevent a recoil assembly from being assembled into the frame. A jig having a right side and a left side to receive and clamp the frame. The jig including three pin hole guides, a removal guide edge for each of the at least one rear restriction protrusion and the at least one front restriction protrusion and a recoil assembly cutout to allow a tool to pass to the recoil assembly block.

DESCRIPTION OF THE CURRENT EMBODIMENT

Figure 1:
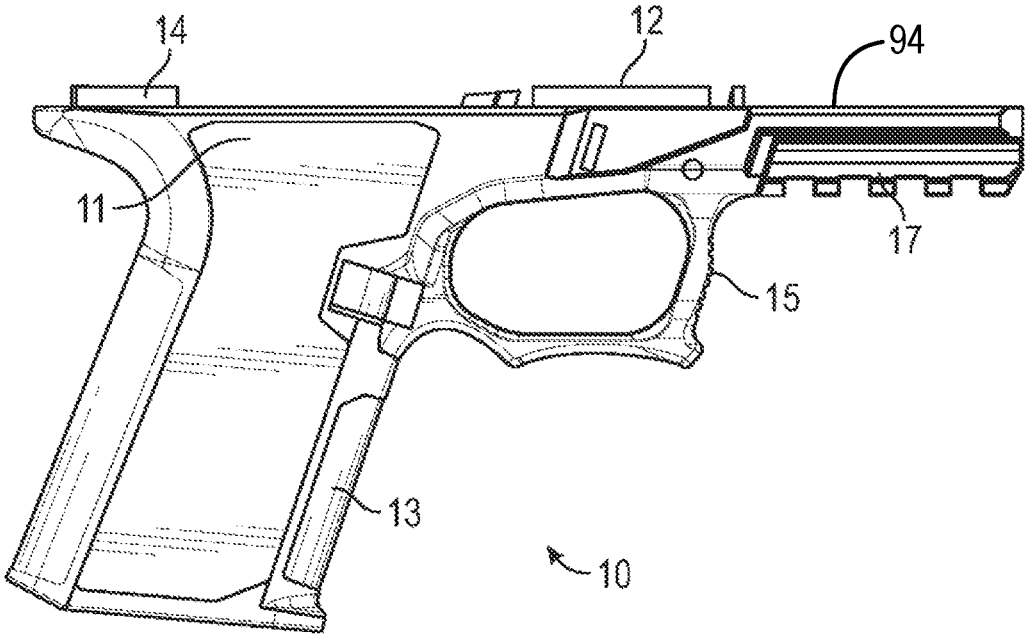
FIG. 1 is a side view of an unfinished frame according to the present invention.
Figure 2:
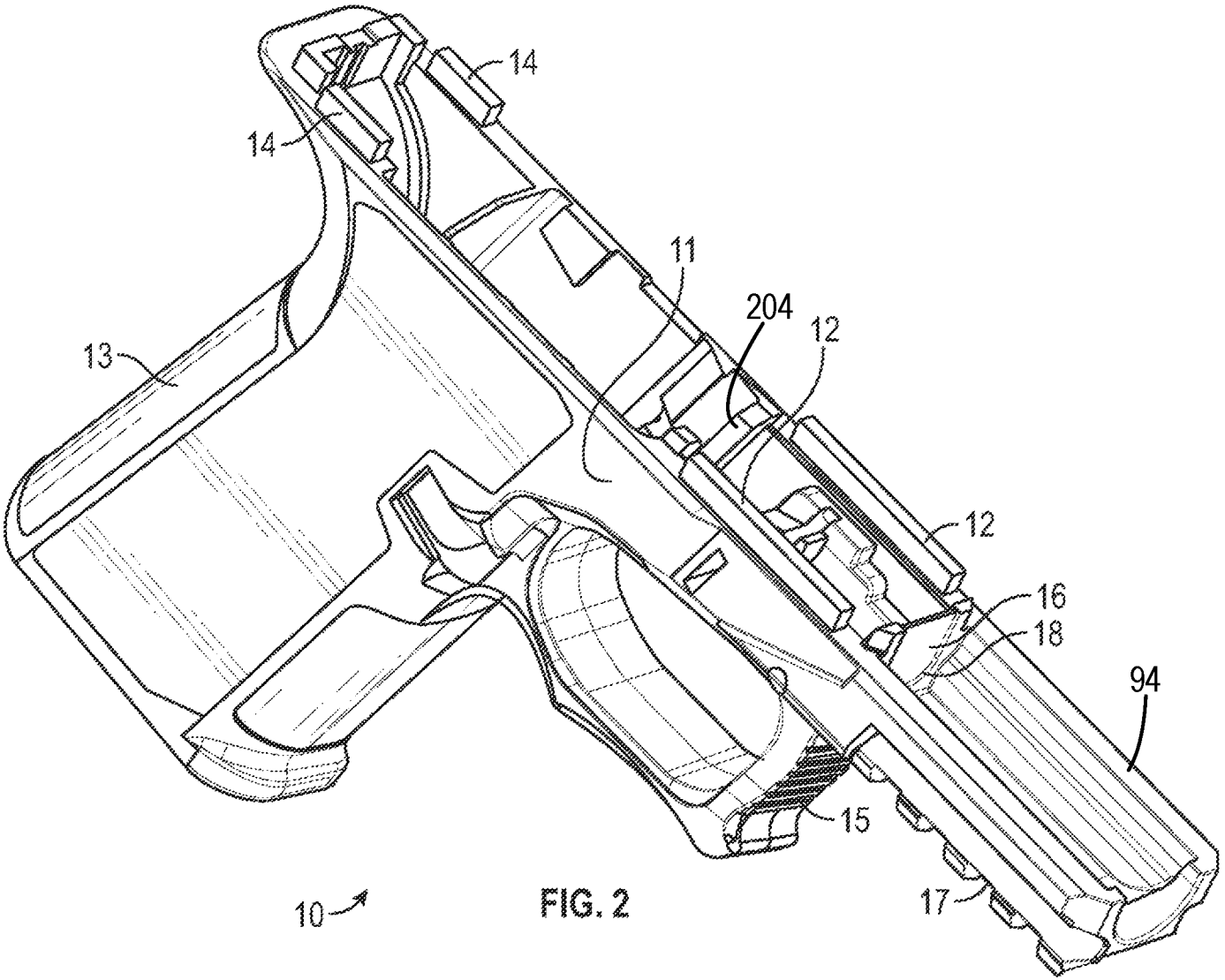
FIG. 2 is a perspective view of an unfinished frame according to the present invention.

Embodiments of an unfinished firearm frame for building a firearm are disclosed. FIGS. 1-10 show a first embodiment of an unfinished frame and the method of finishing the unfinished frame, so it may be used as part of a complete firearm. FIGS. 1-2 show an unfinished frame 10 molded from polymer material. The unfinished frame 10 shown is used with GLOCK firearm parts to assemble a pistol. The unfinished frame 10 includes various open areas and holes to receive firearm parts to complete the unfinished frame 10 into an assembled firearm. The unfinished frame 10 of FIGS. 1-2 is a pistol frame workpiece for modification. The workpiece after modification becomes a pistol frame adapted to receive a slide. The workpiece includes a body 11 having a grip 13, a trigger guard 15, and a forward frame portion 17 extending forward of the grip 13. The body 11 defines an upper plane surface 94 adapted to define a limited gap 96 (shown in FIGS. 10 & 11) with a lower surface of a slide. The body 11 defines a receptacle 98 adapted to receive a rail component (locking block rail inset 48) having upper rail elements (front rails 60 at the top of each side 56) adapted to engage a slide. The body 11 has a block element protruding above the upper plane surface adjacent the receptacle and adapted to prevent full insertion of a rail component by obstructing the receptacle. The forward frame portion has opposed elongated upper edges in part defining the upper plane surface and spaced apart to define an elongated channel 200 adapted to receive an elongated pistol operating component 202. A web 204 is positioned at an intermediate position along the length of the channel. The web spans between the opposed elongated upper edges to divide the channel into a forward portion and a rear portion, and is adapted to prevent the insertion of the elongated pistol operating component.

Figure 3:
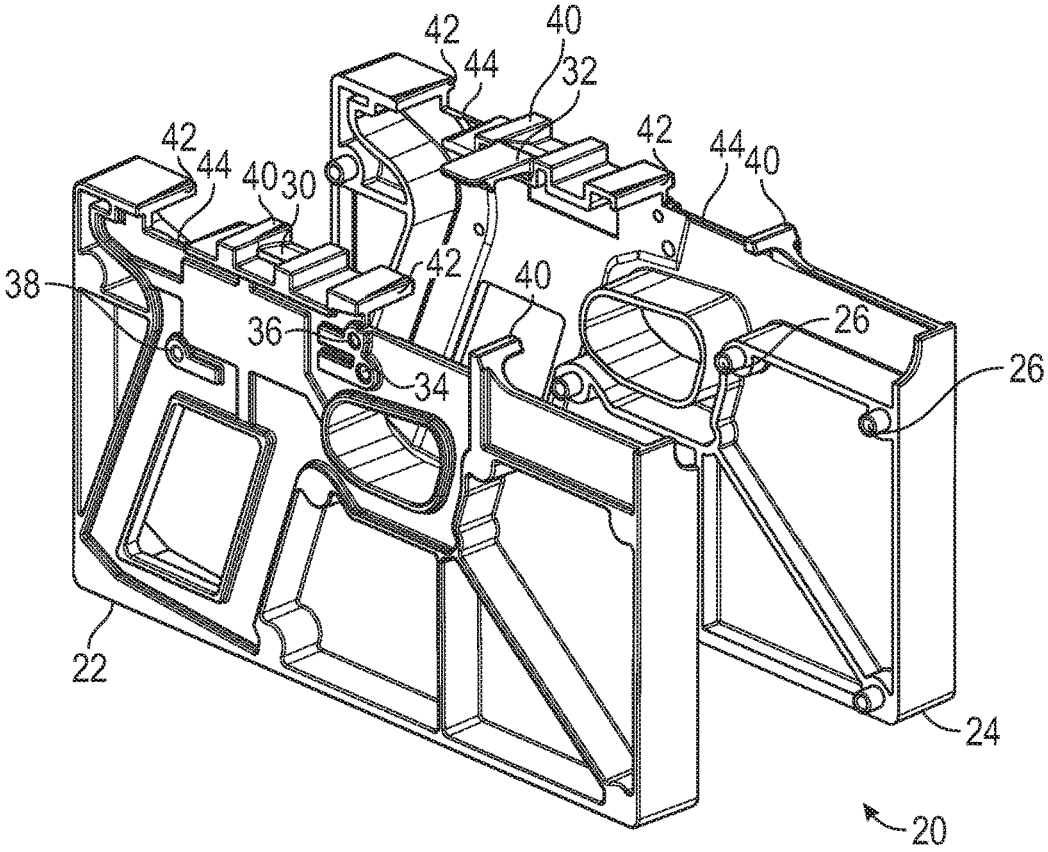
FIG. 3 is a perspective view of a jig according to the present invention.
Figure 4:
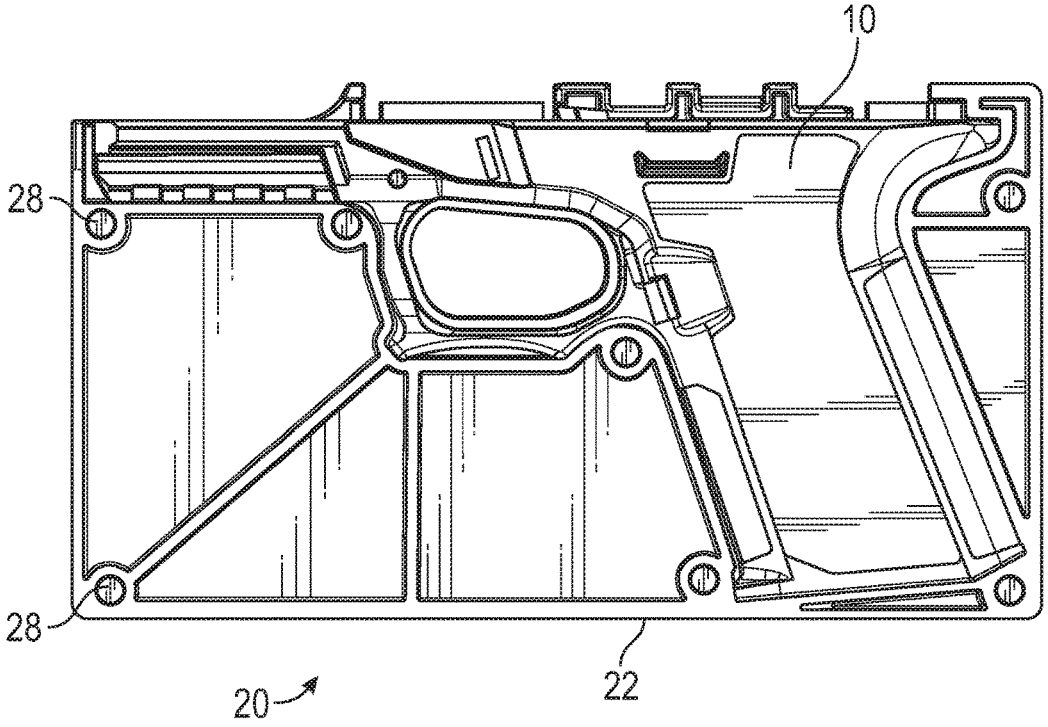
FIG. 4 is a side view of a jig according to the present invention.
Figure 5:
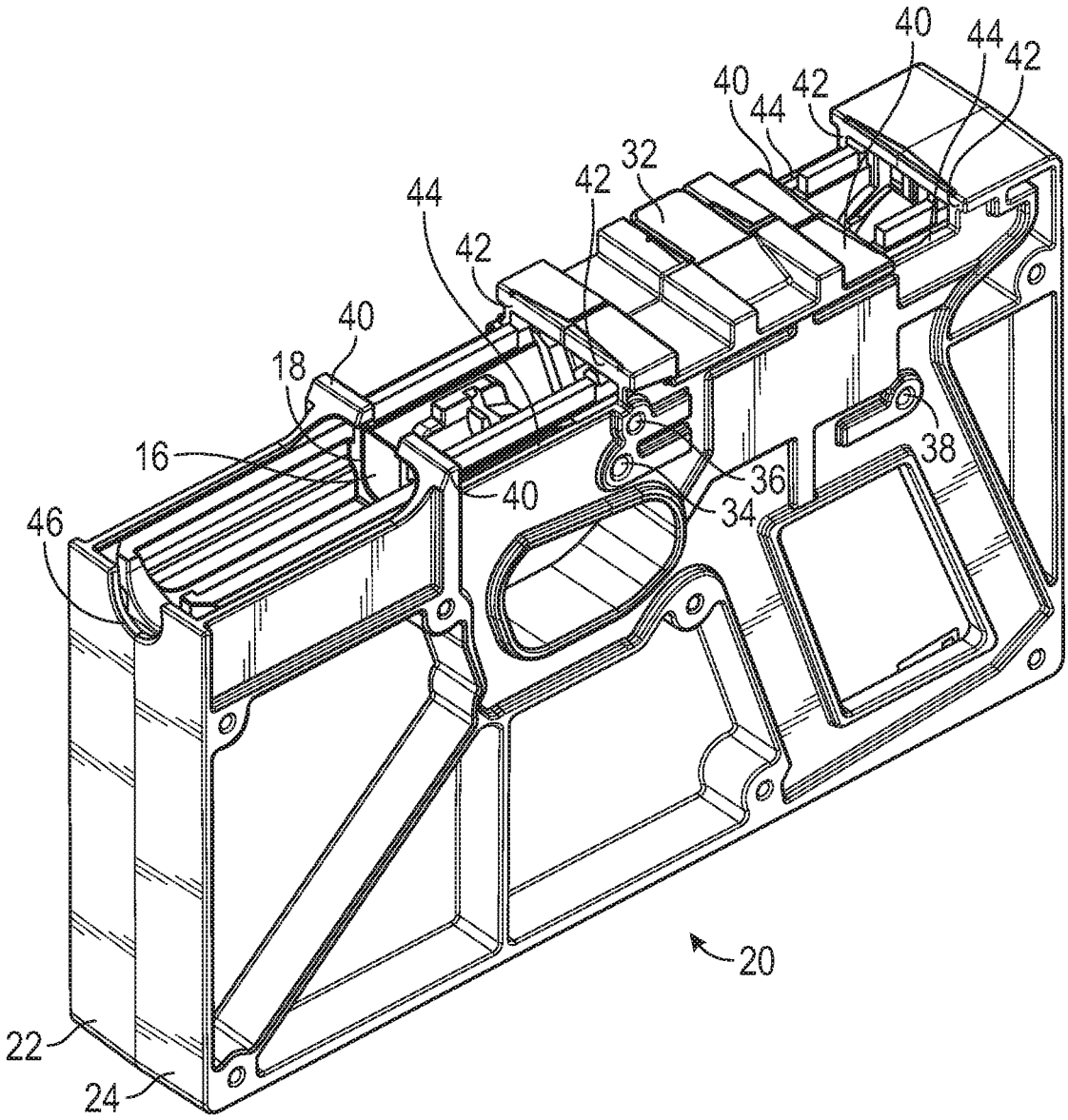
FIG. 5 is a perspective view of a jig according to the present invention.

The unfinished frame 10 does not include three of the required pin holes for assembly the unfinished frame 10 into a firearm. The unfinished frame 10 includes four restriction protrusions that prevent a slide of the pistol to be attached to the unfinished frame 10. FIG. 2 shows the unfinished frame 10 with two front restriction protrusions 12 and two rear restriction protrusions 14. FIG. 2 shows the unfinished frame 10 including a recoil assembly block 16 which prevents a recoil assembly from being installed. The recoil assembly block 16 includes a cutting guide edge 18 formed as part of the unfinished frame 10. FIGS. 3-5 show a jig 20 to be used as a clamping block about the unfinished frame 10. FIG. 3 shows the jig 20 split into a right half 22 and a left half 24. FIG. 4 shows the unfinished frame 10 placed in the right half 22 of the jig 20. FIG. 5 shows the left half 24 of the jig 20 assembled to the right half 22 of the jig 20, thereby enclosing the unfinished frame 20. FIG. 3 shows locating pins 26 on the inside of the left half 24 and FIG. 4 shows locating pin holes 28 for proper assembly of the jig 20. FIG. 3 shows a locking tab 30 on the right half 22 and a locking clip 32 on the left half 24 of the jig 20. The locking clip 32 engages the locking tab 30 when the right half 22 and the left half 24 are assembled, thereby locking the right half 22 and the left half 24 of the jig 20 together. The jig 20 can be clamped into a vise to finish the unfinished frame 10.

The jig 20 includes a first pin hole guide 34, a second pin hole guide 36 and a third pin hole guide 38 on each of the right half 22 and left half 22 of the jig 20, as shown in FIGS. 3 and 5. Each pin hole guide 34, 36, 38 is marked with the corresponding drill bit size to be used. The first pin hole guide 36 is associated with a trigger pin. The second pin hole guide 36 is associated with a locking block pin. The third pin hole guide 38 is associated with a trigger housing pin. Each of the right half 22 and left half 24 of the jig 20 includes open guides at the positions of the front restriction protrusions 12 and the rear restriction protrusions 14, as shown in FIGS. 3-5. The open guides each include a front stop 40, rear stop 42 and removal guide surface 44. Each open guide includes an indicator for what is to be removed from the unfinished frame 10, as shown by the arrow and the word REMOVE. The jig 20 includes recoil assembly cutout 46 formed by the right half 22 and left half 24 to allow an end mill to enter the jig 20 and remove the recoil assembly block 16.

The unfinished frame 10 is finished by inserting the unfinished frame 10 in the jig 20 and clamping the jig 20 in a vise. The first pin hole, second pin hole and third pin hole are all drilled by the correct corresponding drill bit using the pin hole guides 34, 36, 38. Each hole is drilled from each the right half 22 and the left half 24 of the jig 20 into the unfinished frame 10, instead of drilling one time from one side of the jig 20 and through the unfinished frame 10 onto the other side of the jig 20. The front restriction protrusions 12 and the rear restriction protrusions 14 are removed using the removal guide surface 44. Typically, a milling machine tool is used for removal of the front restriction protrusions 12 and the rear restriction protrusions 14. The removal guide surface is used to prevent too much material from being removed. Finally, the recoil assembly block 16 is removed by inserting an end mill against the recoil assembly block 16 from the direction of the recoil assembly cutout 46 and using the cutting guide edge 18. The cutting guide edge 16 is used to prevent too much material from being removed.

Figure 6:
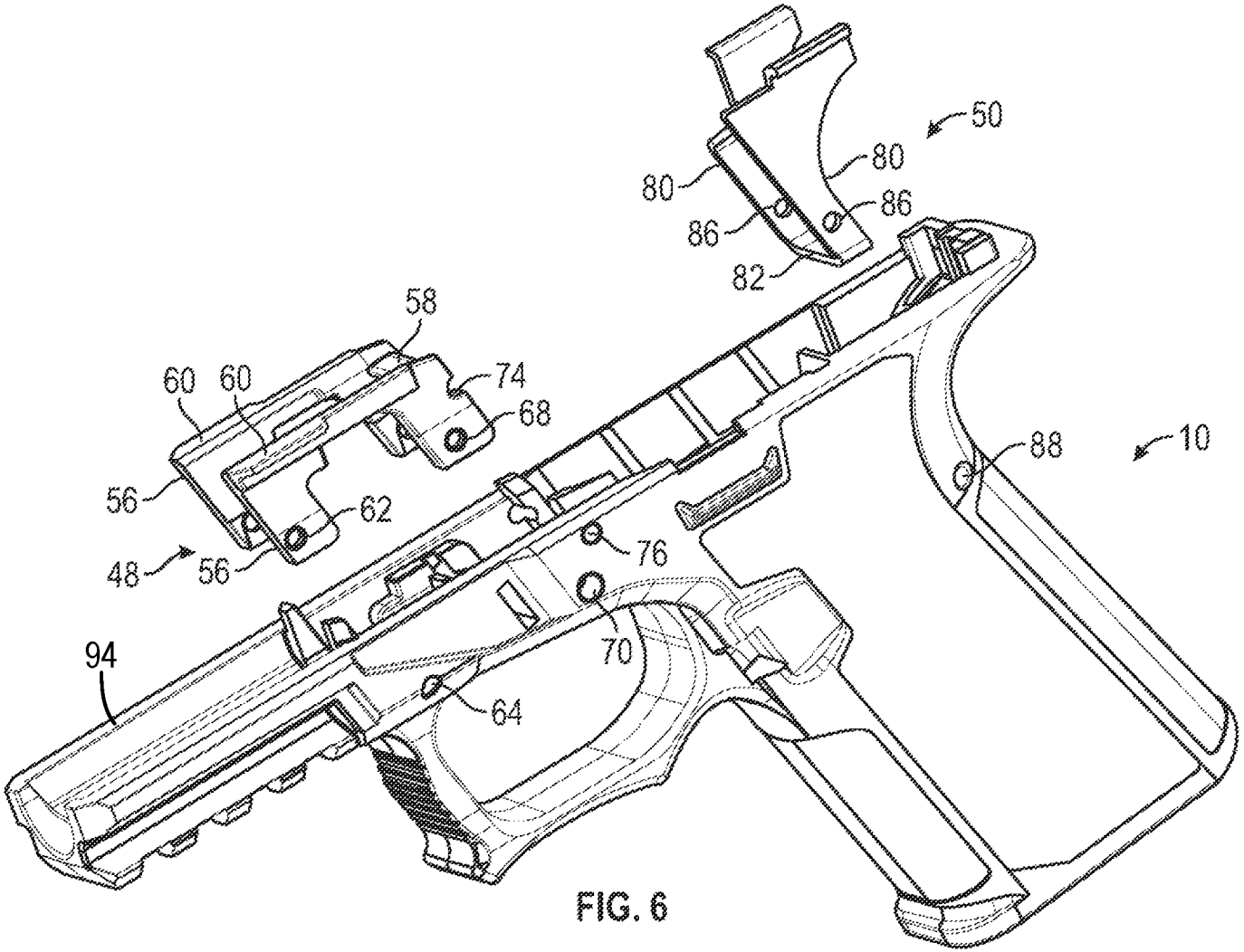
FIG. 6 is a perspective view of an unfinished frame with parts according to the present invention.
Figure 7:
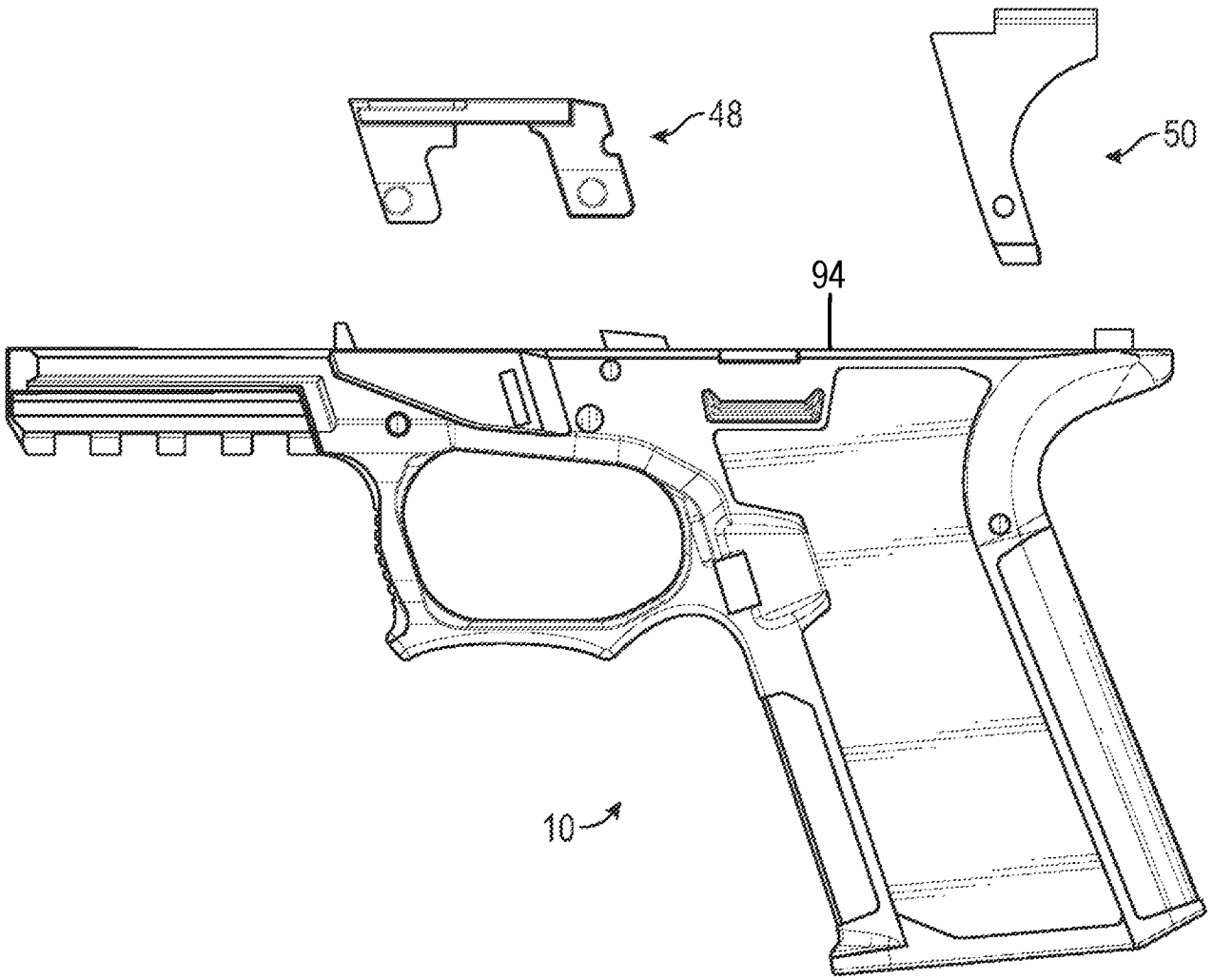
FIG. 7 is a side view of an unfinished frame with parts according to the present invention.
Figure 8:
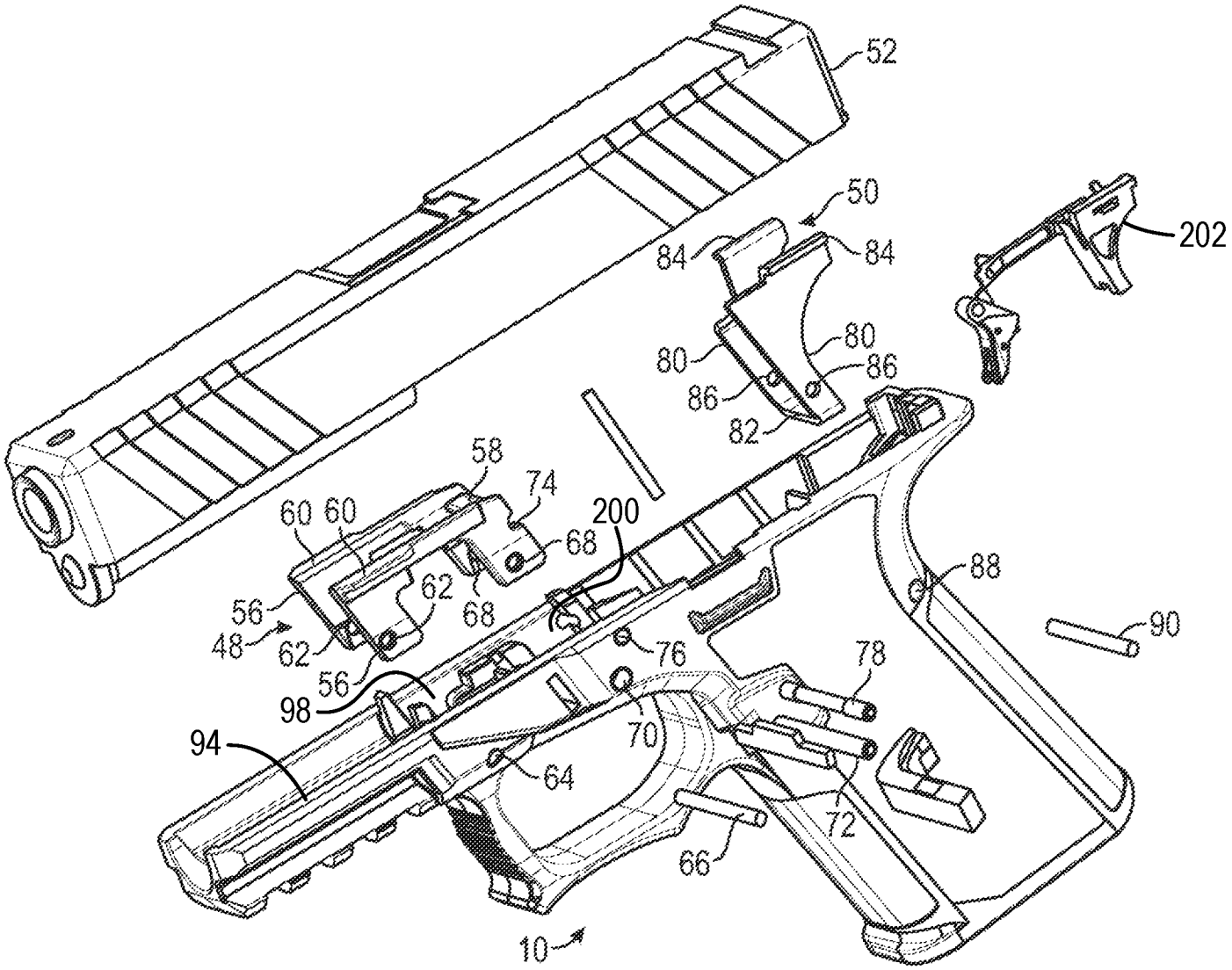
FIG. 8 is a perspective view of an unfinished frame with parts according to the present invention.
Figure 9:
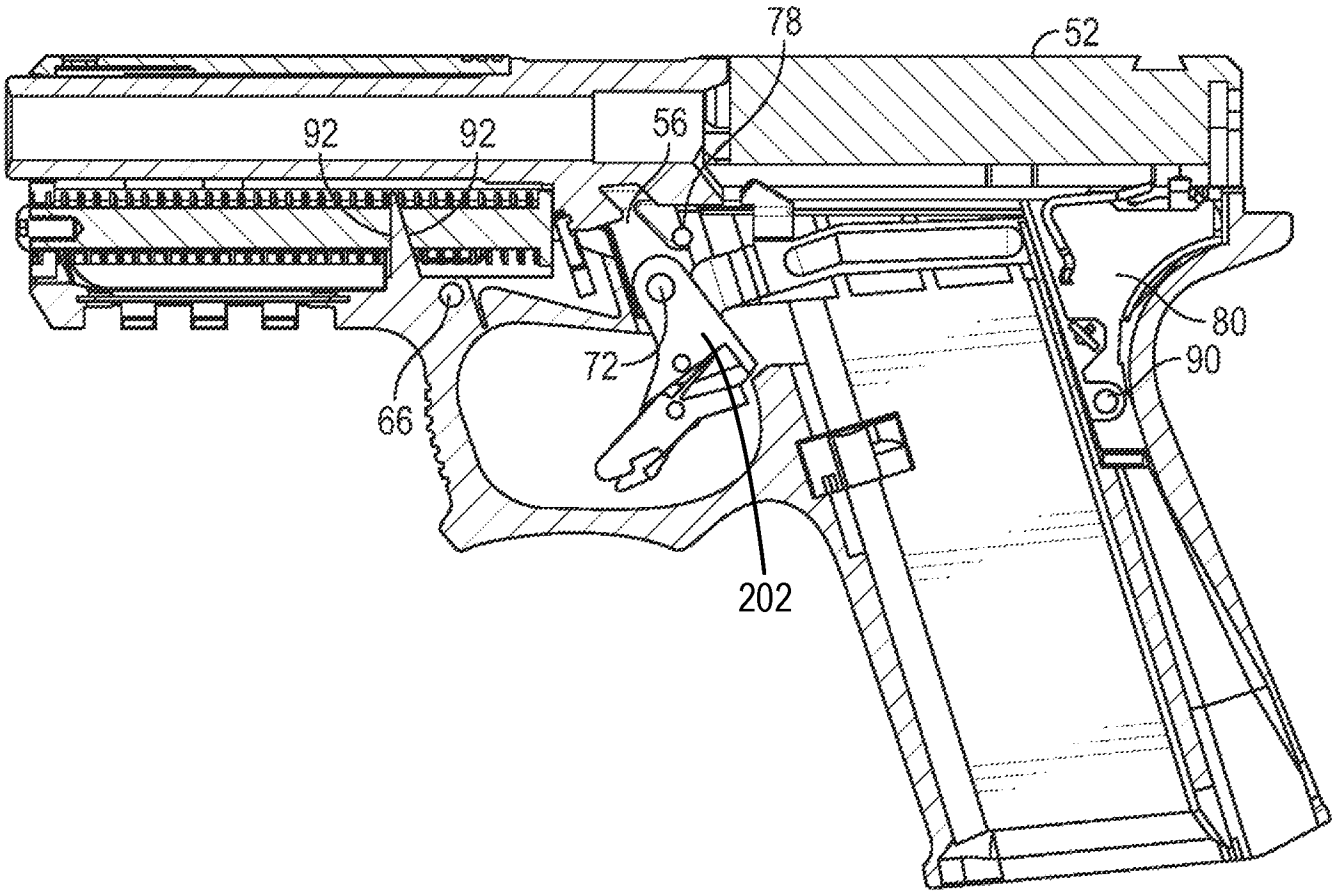
FIG. 9 is a side cross sectional view of a finished frame with parts according to the present invention.
Figure 10:
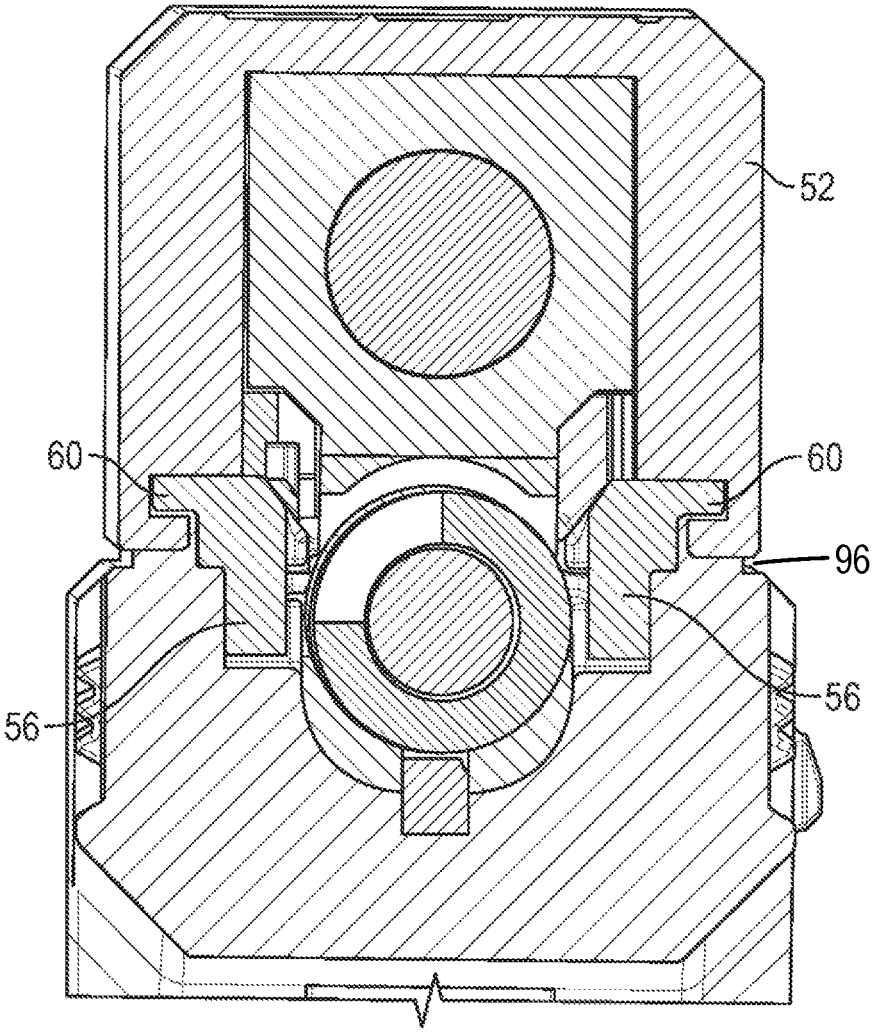
FIG. 10 is a front cross sectional view of a finished frame according to the present invention.
Figure 11:
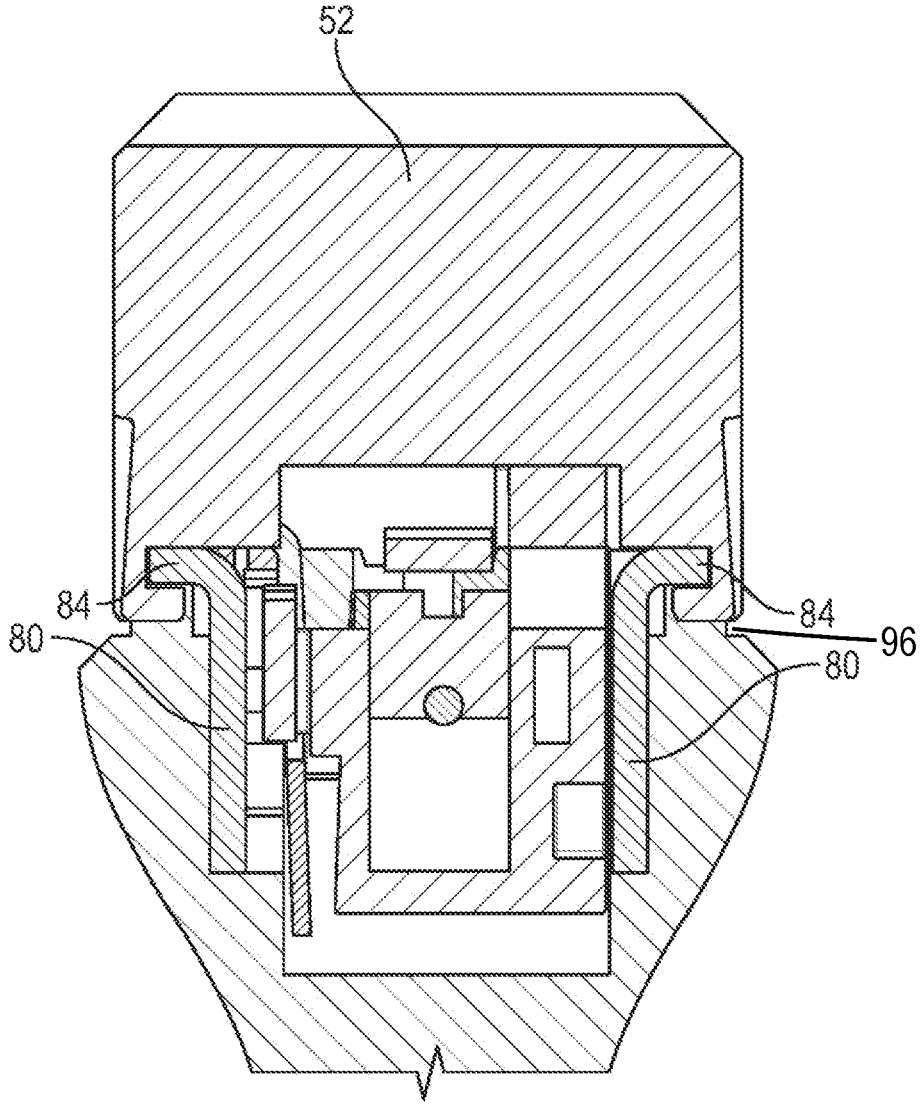
FIG. 11 is a rear cross sectional view of a finished frame according to the present invention.

A pistol frame includes slide rails on the top of the frame to receive and locate the slide of the firearm onto the frame. The slide rails are milled or formed as part of the pistol frame by pistol manufacturers. Polymer pistol frames typically have two front rails and two rear rails. The first embodiment includes the use of a locking block rail insert 48 and a rear rail insert 50, as shown in FIGS. 6-7. FIG. 8 shows the slide 52 and pins used, along with other firearm parts. The locking block rail insert 48 and the rear rail insert 50 are installed in the unfinished frame 10 after modifying the unfinished frame 10 in the jig 20 to provide the front and rear rails required to install the slide 52. The locking block rail insert 48 is a frame with two sides 56 and a cross member 58. The locking block rail insert 48 includes a front rail 60 at the top of each side 56. The sides 56 each include a front hole 62 at the front of the locking block rail insert 48 which aligns with a pin hole 64 preformed in the unfinished frame 10. The front hole 62 is for a front locking block pin 66 to pass through the unfinished frame 10 and aid in holding the locking block rail insert 48 in position. The sides 56 each include a rear hole 68 at the rear of the locking block rail insert 48 which aligns with the first pin hole 70 on the unfinished frame 10, so that a trigger pin 72 may pass and aid in holding the locking block rail insert 48 in position. Thus, the first pin hole 70 serves as an aperture defined by the body 11 at the receptacle 98 adapted to receive a pin engaging the rail component (locking block rail insert 48). The sides 56 each include a semi-circle cut out 74 above the rear hole 68 which aligns with the second pin hole 76 on the unfinished frame 10, so that a locking block pin 78 may pass and aid in holding the locking block rail insert 56 in position. The unfinished frame 10 includes surfaces within the unfinished frame 10 that interact with edges of the sides 56 to provide support for the locking block rail insert 48 and lock the locking block rail insert 48 in position. The rear rail insert 50 is a frame with two sides 80 and a cross member 82. The rear rail insert 50 includes a rear rail 84 at the top of each side 80. The sides 80 include a lower hole 86 which aligns with the third pin hole 88 on the unfinished frame 10, so that a trigger housing pin 90 may pass and aid in holding the rear rail insert 50 in position. The unfinished frame 10 includes surfaces within the unfinished frame 10 that interact with edges of the sides 80 to provide support for the rear rail insert 50 and lock the rear rail insert 50 in position. FIG. 9 shows a side cross section of an assembled firearm using unfinished frame 10. Lines 92 in FIG. 9 denote where the recoil assembly block 16 was removed. FIG. 10 shows a front cross section of the slide 52 and rail area of the assembled firearm of FIG. 9 that includes the locking block rail insert 48. FIG. 11 shows a rear cross section of the slide 52 and rail area of the assembled firearm of FIG. 9 that includes the rear rail insert 50.

Figure 12:
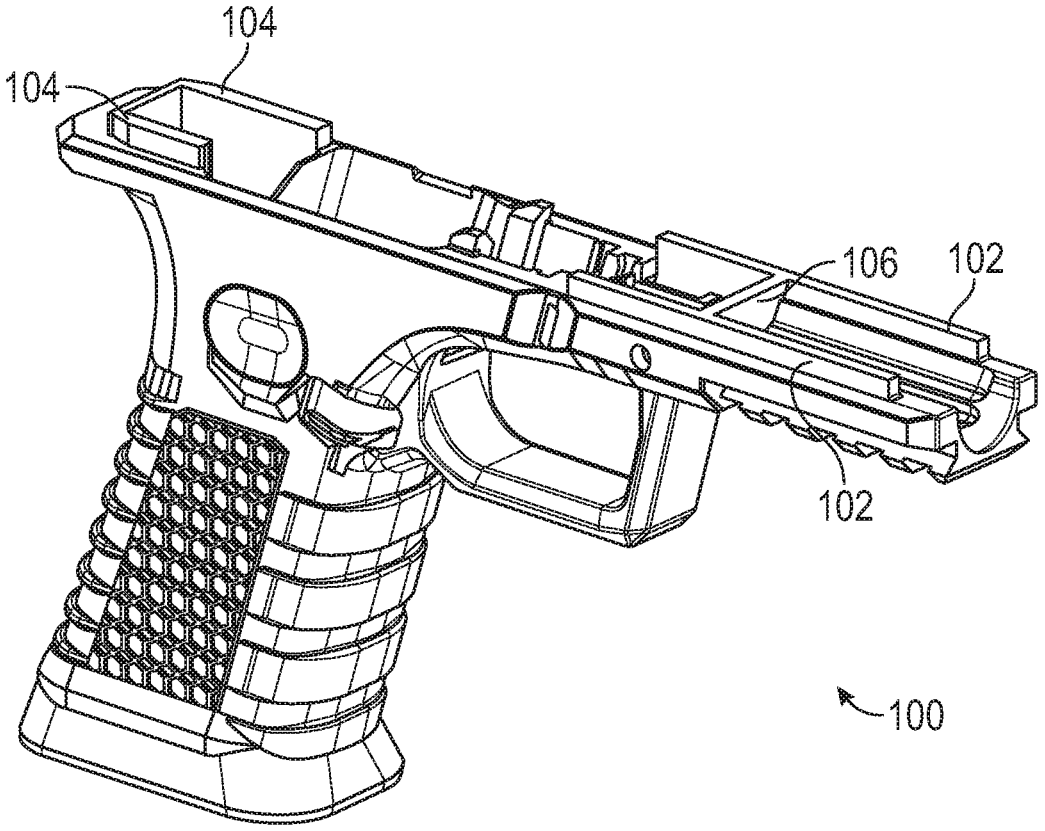
FIG. 12 is a perspective view of a second embodiment of an unfinished frame according to the present invention.
Figure 13:
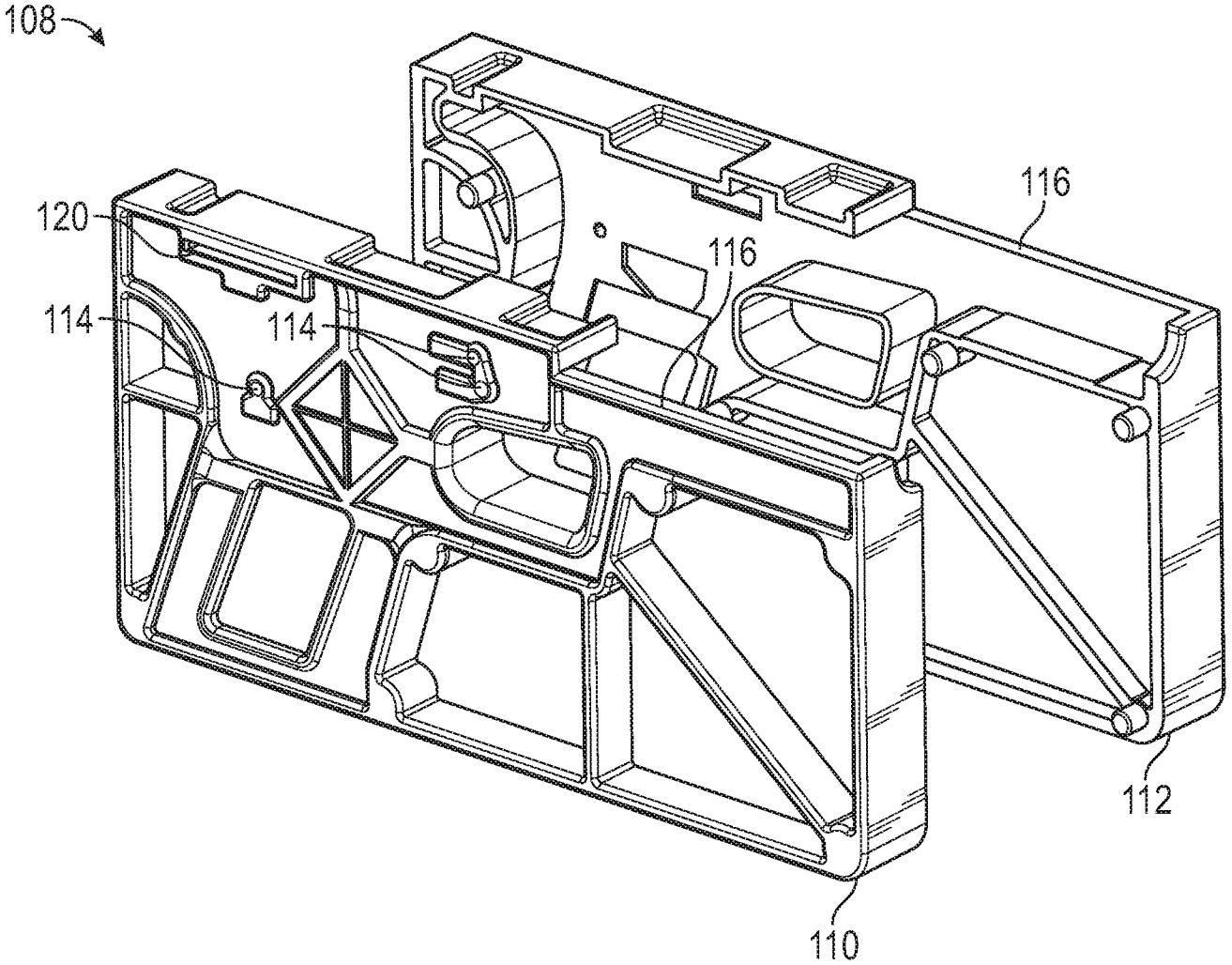
FIG. 13 is a perspective view of a second embodiment of a jig according to the present invention.
Figure 14:
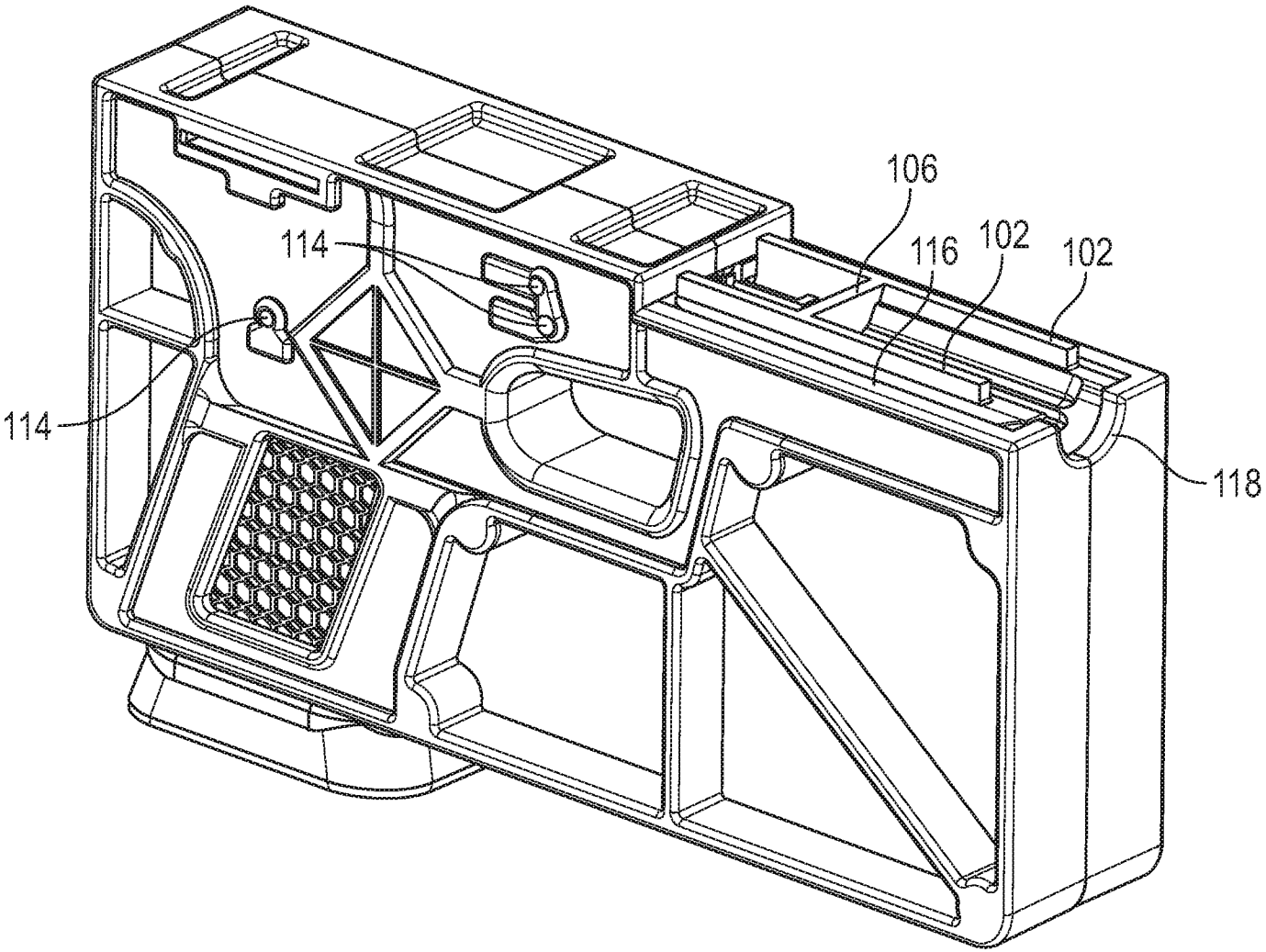
FIG. 14 is a perspective view of a second embodiment of a jig according to the present invention.
Figure 15:
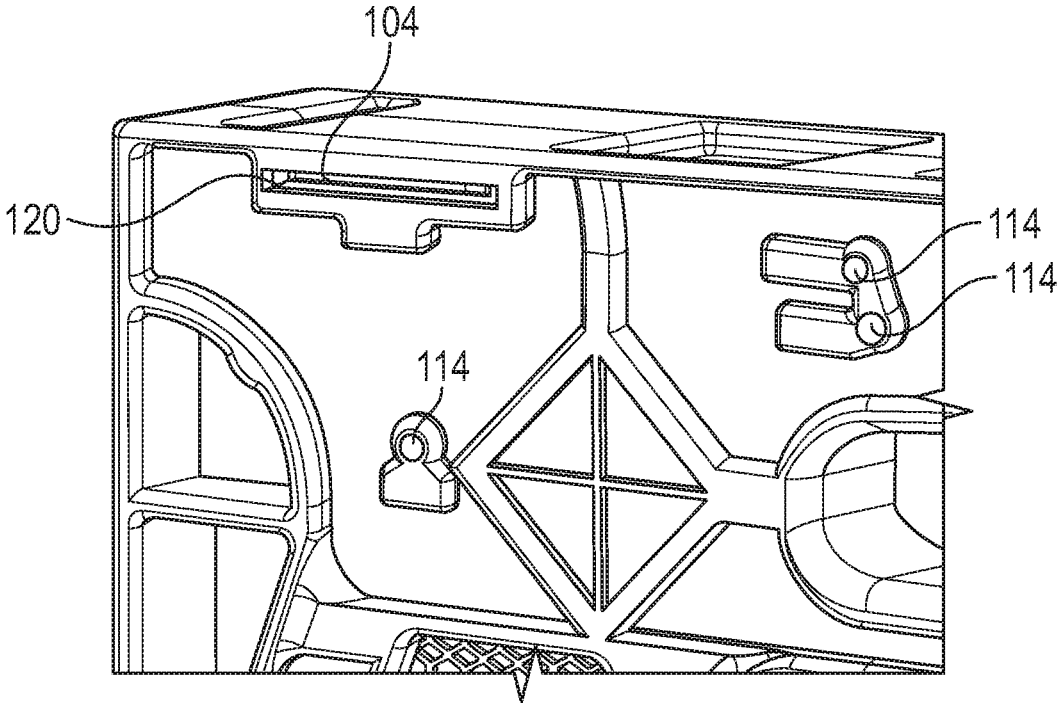
FIG. 15 is a perspective view of a second embodiment of a jig according to the present invention.
Figure 16:
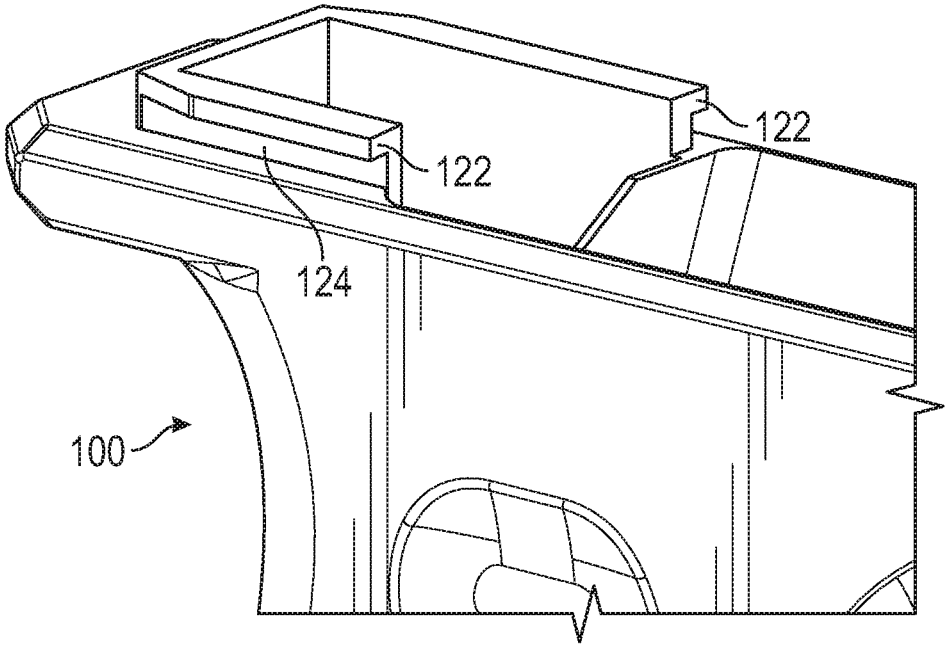
FIG. 16 is a perspective view of a finished rail according to the present invention.

FIGS. 12-16 show a second embodiment. FIG. 12 shows an unfinished frame 100 with front restriction protrusions 102, rear restriction protrusions 104 and recoil assembly block 106. FIGS. 13-14 shows a jig 108 with a right half 110 and left half 112. The jig 108 includes three pin hole guides 114 labeled with the corresponding drill bit size to be used for drilling. Each of the right half 110 and left half 112 of the jig 108 includes a removal guide surface 116 for removing the front restriction protrusions 102. Each of the right half 110 and left half 112 of the jig 108 together form a recoil assembly cutout 118 to allow an end mill to enter the jig 108 and remove the recoil assembly block 106. Each of the right half 110 and left half 112 of the jig 108 includes a rail slot 120 near the rear of the jig 108. FIG. 15 shows a close up the rail slot 120 where a milling tool can be inserted to remove material from the rear restriction protrusions 104 to form a rear rail 122. FIG. 16 shows a close up of the area 124 where the material was removed to form the rear rail 122 by using the rail slot 120 of the jig 108.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

We claim:

1. A pistol frame workpiece for modification to become a pistol frame adapted to receive a slide, the workpiece comprising:

a body having a grip, a trigger guard, and a forward frame portion extending forward of said grip;

an upper plane surface defined by said body adapted to define a limited gap with a lower surface of the slide when the slide is in an installed condition;

a block element protruding above said upper plane surface of said body adjacent a receptacle and adapted to prevent positioning of the slide in the installed condition; and wherein there is at least one rear restriction protrusion extending from said top of said frame near a rear of said frame which obstructs addition of the slide to said frame;

wherein there is at least one front restriction protrusion extending from said top of said frame and forward of said at least one rear restriction protrusion which obstructs addition of the slide to said frame; and wherein each of the at least one rear restriction protrusion and the at least one front restriction protrusion have adjacent associated receptacles.

2. The pistol frame workpiece of claim 1, wherein said at least one front restriction protrusion comprises at least two front restriction protrusions and said at least one rear restriction protrusion comprise at least two rear restriction protrusions.

3. The pistol frame workpiece of claim 1, further including a jig, said jig having a right side and a left side to receive and clamp said frame, said jig including three pin hole guides, said jig including a removal guide edge for each of said at least one rear restriction protrusion and said at least one front restriction protrusion.

4. The pistol frame workpiece of claim 3, further including a rear rail insert for mounting in a rear portion of said frame, said rear rail insert including two rails to adapted to engage the slide; and further including a locking block insert for mounting forward of said rear rail insert in said frame, said locking block rail insert including two rails to adapted to engage the slide.

5. The pistol frame workpiece of claim 4, wherein said rear rail insert includes two sides and a cross member, said sides of said rear rail insert each include a lower hole adapted to align a hole drilled at one of said pin hole guides of said jig; and wherein said locking block rail insert is a frame with two sides and a cross member, said sides of said locking block rail insert each include at least one hole and semi-circle cut out adapted to align holes drilled at two of said pin hole guides of said jig.

6. The pistol frame workpiece of claim 5, further comprising a second hole on each side of said locking block rail insert and further including a pre-drilled pin hole that aligns with said second hole of said locking block rail insert.

7. The pistol frame workpiece of claim 3, wherein one of said pin hole guides provides for drilling a pin hole for a locking block pin; wherein one of said pin hole guides provides for drilling a pin hole for a trigger pin; and wherein one of said pin hole guides provides for drilling a pin hole for a trigger housing pin.

8. The pistol frame workpiece of claim 3 including a recoil assembly block adapted to prevent a recoil assembly from being assembled into said frame, and said jig including recoil assembly cutout to allow a tool to pass to said recoil assembly block.

9. The pistol frame workpiece of claim 1 including a recoil assembly block adapted to prevent a recoil assembly from being assembled into said frame, wherein said recoil assembly block includes a cutting guide edge for removal of said recoil assembly block.

10. The pistol frame workpiece of claim 1, further including a jig, said jig having a right side and a left side to receive and clamp said frame, said jig include three pin hole guides, said jig including a removal guide edge for each of said at least one front restriction protrusion, and said jig including a rail slot for removing material along said at least one rear restriction protrusion to form a rear rail on said frame.

* * * * *